US009257806B2

(12) United States Patent
Lai et al.

(10) Patent No.: US 9,257,806 B2
(45) Date of Patent: Feb. 9, 2016

(54) PLIERS FOR CRIMPING TERMINALS ON WIRES OR CONDUCTORS

(71) Applicants: Chang-Keng Lai, Taichung (TW); Chia-Mao Lai, Taichung (TW)

(72) Inventors: Chang-Keng Lai, Taichung (TW); Chia-Mao Lai, Taichung (TW)

( * ) Notice: Subject to any disclaimer, the term of this patent is extended or adjusted under 35 U.S.C. 154(b) by 307 days.

(21) Appl. No.: 14/103,804

(22) Filed: Dec. 11, 2013

(65) Prior Publication Data

US 2015/0162716 A1 Jun. 11, 2015

(51) Int. Cl.
*H01R 43/042* (2006.01)
*B25B 27/14* (2006.01)
*B25B 7/04* (2006.01)

(52) U.S. Cl.
CPC ..... *H01R 43/042* (2013.01); *B25B 7/04* (2013.01); *B25B 27/146* (2013.01)

(58) Field of Classification Search
CPC ..... B25B 7/02; B25B 7/04; B25B 27/146; H01R 43/042
See application file for complete search history.

(56) References Cited

U.S. PATENT DOCUMENTS 3,314,135 A 4/1967 Smith
3,406,558 A * 10/1968 Tillmann ..... H01R 43/042 29/751
7,350,393 B2 * 4/2008 Li ..... B25B 7/04 29/751
7,536,896 B1 * 5/2009 Hung ..... B25B 7/04 29/751
7,628,052 B2 * 12/2009 Zhang ..... B25B 27/146 72/409.16
8,677,866 B2 * 3/2014 Steele ..... B25B 7/04 72/413
9,073,193 B2 * 7/2015 Zeng ..... B25B 7/08 81/302
2009/0217791 A1 * 9/2009 Battenfeld ..... B25B 7/04 81/421
2009/0308132 A1 * 12/2009 Lai ..... H01R 43/042 72/409.16
2010/0071202 A1 * 3/2010 Peng ..... B25B 27/146 29/751
2010/0101379 A1 * 4/2010 Hofmann ..... B25B 7/02 81/423

* cited by examiner

*Primary Examiner* — David B Thomas

(57) ABSTRACT

Pliers include a pair of handles, at least one arm member connected to one of the handles, a seat body secured in a receiving room of the arm member, a working jaw detachably engaged with the seat body, and a control assembly to control whether the working jaw is allowed to be released from the seat body. The working jaw defines in a side thereof an indentation to be communicated with a through hole of the seat body. The control assembly has a knob and a positioning pin. Rotation of the knob displaces the knob axially with respect to the seat body, causing the positioning pin to move between a locking position to stop the working jaw from departing from the seat body, and a releasing position where the working jaw is allowed to be removed from the seat body.

8 Claims, 6 Drawing Sheets

PLIERS FOR CRIMPING TERMINALS ON WIRES OR CONDUCTORS

BACKGROUND OF THE INVENTION

1. Field of the Invention

The present invention relates to pliers and more particularly to pliers with replaceable working jaws for crimping terminals on wires or conductors.

2. Description of the Related Art

As disclosed in U.S. Pat. No. 3,314,135, conventional crimping pliers often provide a pair of working jaws attached to two arm members of the crimping pliers by screws. Thus, the working jaws with different sizes or shapes may be removed by loosening the screws and replaced by new ones and finally re-tightening the screws back again. Furthermore, to avoid undesired rotation of the working jaws, at least two screws will have to be employed in order to retain each of the working jaws on the respective arm member. That is to say, at least four screws will have to be dealt with if the working jaws are to be replaced. This can be a really tiresome piece of work.

SUMMARY OF THE INVENTION

Accordingly, it is an object of the present invention to provide improved pliers with replaceable working jaws which can be easily and quickly attached and detached from the rest of the pliers.

Specifically, the pliers include a pair of arm members, a pair of handles, at least one seat body, at least one working jaw and at least one control assembly. The handles are connected to each other for movement of the arm members towards and away from each other. The seat body is secured in a receiving room of one of the arm members and defines a through hole in a direction substantially vertical to the arm member. The working jaw is detachably engaged with the seat body to be supported in the receiving room of the arm member, and defines in a side thereof an indentation to be communicated with the through hole of the seat body. The control assembly includes a knob and a positioning pin. The knob is disposed in an opening of the through hole of the seat body. The positioning pin has a free end passing through the through hole of the seat body and an opposite end secured to the knob. In particular, the knob and the seat body are arranged in a manner that rotation of the knob displaces the knob axially with respect to the seat body. This causes the positioning pin to move between a locking position where the free end of the positioning pin is engaged in the indentation of the working jaw to stop the working jaw from departing from the seat body, and a releasing position where the free end of the positioning pin is removed from the indentation of the working jaw to allow detachment of the working jaw from the seat body.

Preferably, the positioning pin is formed at the free end with an outer flange and at the opposite end with a threaded portion screwed in a screw hole of the knob. The seat body is formed an inner flange in the through hole thereof. And, the control assembly further includes a spring disposed around the positioning pin and interposed between the outer flange of the positioning pin and the inner flange of the seat body.

Further benefits and advantages of the present invention will become apparent after a careful reading of the detailed description with appropriate reference to the accompanying drawings.

DETAILED DESCRIPTION OF EMBODIMENTS

Figure 1:
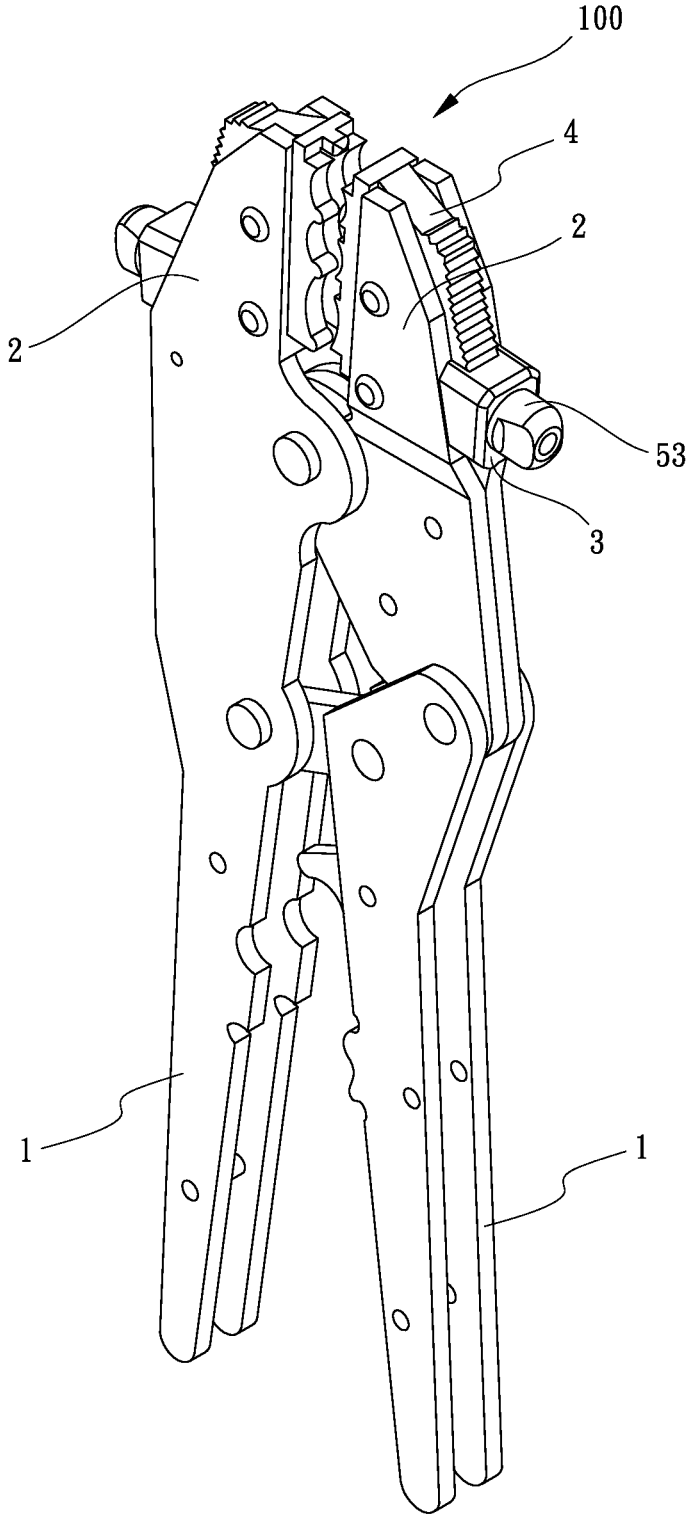
FIG. 1 is a perspective view of pliers in accordance with the preferred embodiment of the present invention.

Referring now in detail to the drawing, there are shown pliers 100 for crimping terminals on wires or connectors according to the preferred embodiment of the invention. As shown, the pliers 100 include a pair of handles 1, a pair of arm members 2 and a pair of working jaws 4. The left-hand arm members 2 is rigidly connected to or integrated with the left handle 1. The right-hand arm member 2 is pivotally connected to the right-hand handle 1 by means of a pivot pin (not numbered). The handles 1 are pivotally connected for movement of the arm members 2 towards and away from each other. The working jaws 4 can be interchanged with other pairs of jaws and they are fixed to their associated arm members 2 in a manner which will be described later in further detail.

Figure 2:
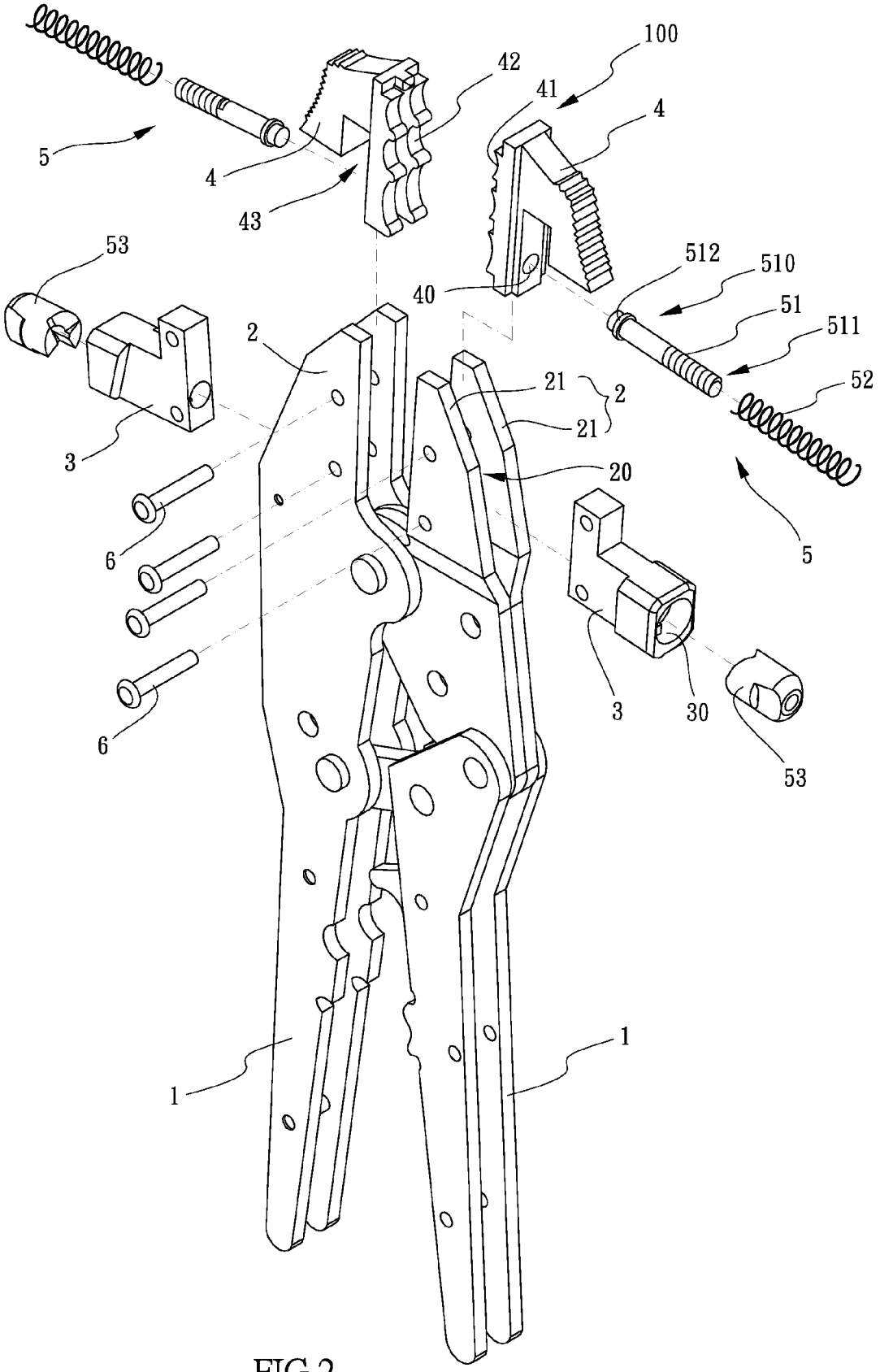
FIG. 2 is an exploded perspective view of the pliers shown in FIG. 1.
Figure 4:
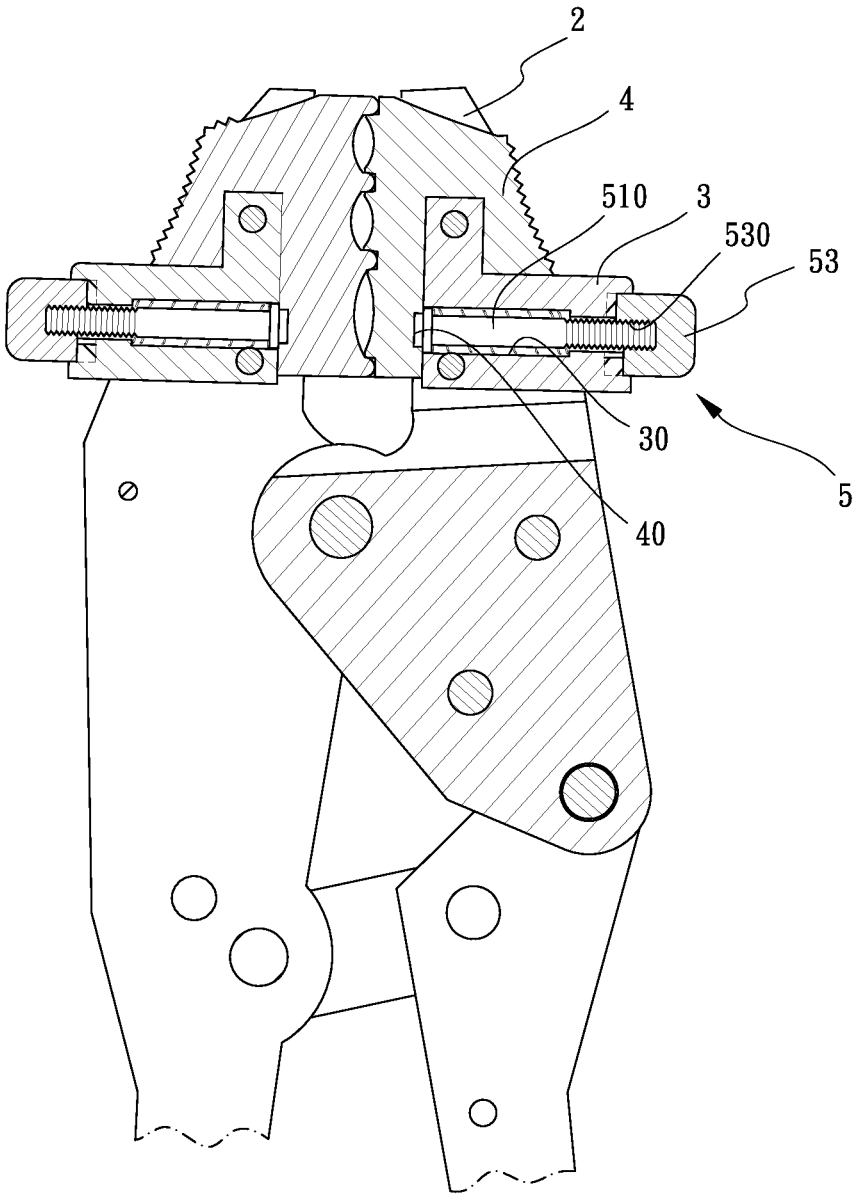
FIG. 4 is a partial cross-sectional view of the pliers shown in FIG. 1.

Referring to FIG. 2, the pliers 100 further include a pair of seat bodies 3 and a pair of control assemblies 5. Each of the seat bodies 3 is secured in a receiving room 20 of the respective arm member 2 by means of bolts 6. In this example, each arm member 2 is formed by two spaced apart, parallel metal sheets 21 and the receiving room 20 is defined in between the two metal sheets 21. Each of the working jaws 4 is detachably engaged with the respective seat body 3, as best shown in FIG. 4, to be supported in the receiving room 20 of the arm member 2. The two working jaws 4 are provided with press dies 41 arranged side by side and female molds 42 opposite to the press dies 41. Each of the seat bodies 3 is configured substantially L-shaped. Each of the working jaws 4 defines a substantially L-shaped notch to accommodate the respective seat body so as to limit lateral movement of the working jaw. Moreover, each of the seat bodies 3 defines a through hole 30 in a direction substantially vertical to the arm member 2. On the other hand, each of the working jaws 4 defines in a side thereof an indentation 40 to be communicated with the through hole 30 of the seat body 30, as shown in FIG. 4.

Figure 5:
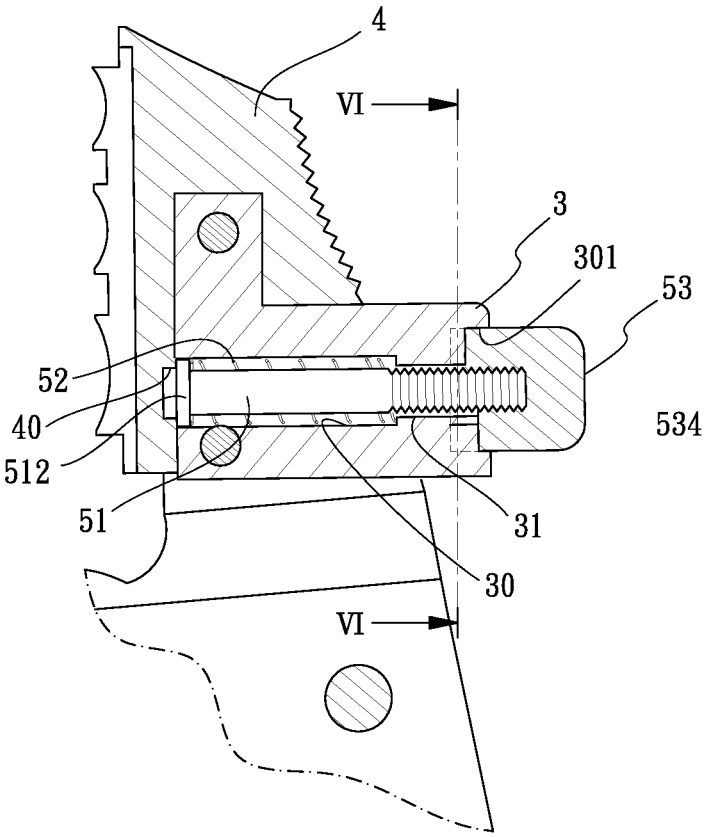
FIG. 5 is a partial enlarged view of the pliers shown in FIG. 4, showing that the working jaw (4) is retained by the positioning pin (51)

Referring back to FIG. 2, each of the control assemblies 5 includes a positioning pin 51, a compression spring 52 and a knob 53. The knob 53 is disposed in an opening 301 of the through hole 30 of the seat body 3. The positioning pin 51 has a free end 510 passing through the through hole 30 of the seat body 3, and an opposite end 511 secured to an inner side of the knob 53, as illustrated in FIG. 4. More specifically, the positioning pin 51 is formed at the free end 510 with an outer flange 512 and at the opposite end 511 with a threaded portion screwed in a screw hole 530 of the knob 53. As best seen in FIG. 5, the seat body 3 is formed an inner flange 31 in the through hole 30 thereof. The compression spring 52 is disposed around the positioning pin 51 and is interposed between the outer flange 512 of the positioning pin 51 and the inner flange 31 of the seat body 3, ensuring that the free end 510 of the positioning pin 51 is firmly fastened in the indentation 40 of the working jaw 4.

Figure 8:
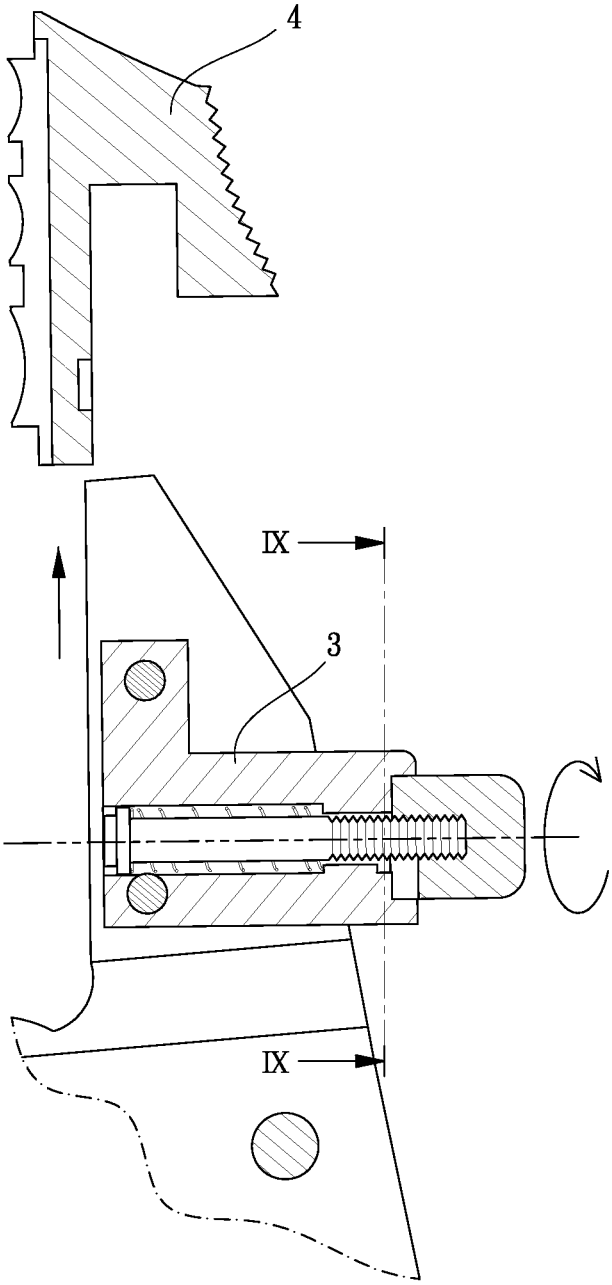
FIG. 8 is a view similar to FIG. 5, showing that the working jaw (4) is released from the positioning pin (51)

In particular, the knob 53 and the seat body 3 are arranged in a manner that rotation of the knob 53 displaces the knob 53 axially with respect to the seat body 3, causing the positioning pin 51 to move between a locking position, as depicted in FIG. 5, and a releasing position, as depicted in FIG. 8. When the positioning pin 51 is in the locking position, the free end 510 of the positioning pin 51 is engaged in the indentation 40 of the working jaw 4 to stop the working jaw 4 from departing from the seat body 3. In contrast, when the positioning pin 51 is in the releasing position, the free end 510 of the positioning pin 51 is removed from the indentation 40 of the working jaw 4 to allow detachment of the working jaw 4 from the seat body 3.

Figure 3:
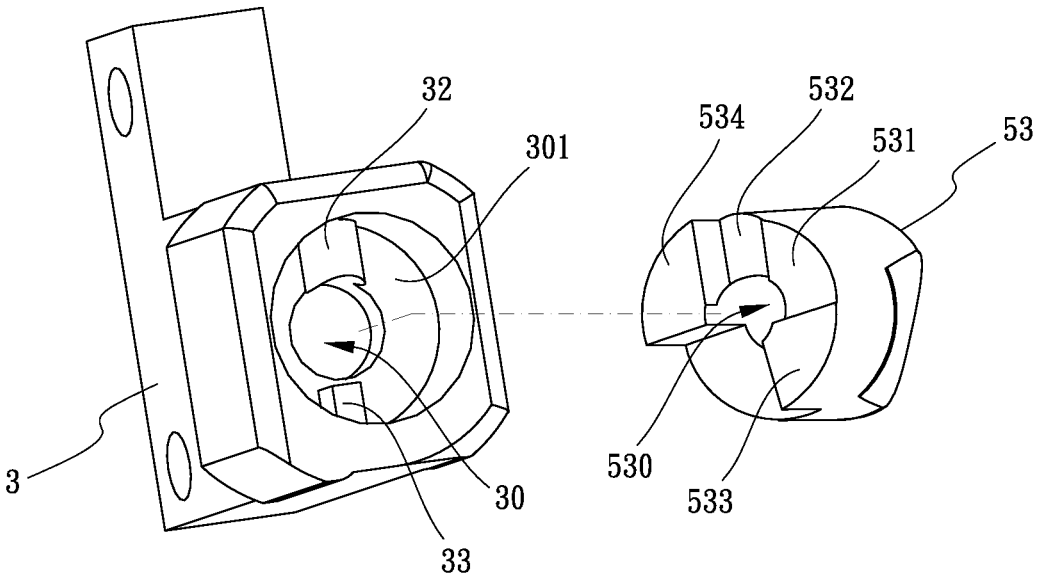
FIG. 3 is a perspective view, to an enlarged scale, of the seat body (3) and the knob (53) of the pliers shown in FIG. 2 at a different angle.

More specifically, as shown in FIG. 5, the opening 310 of the through hole 30 of the seat body 3 is enlarged to form an annular bottom, as best seen in FIG. 3, onto which a rib 32 and a confining block 33 substantially opposite to the rib 32 are formed. The knob 53, on the other hand, is formed at its inner side with a guiding slope 531 in an arc corresponding to the rib 32 of the seat body 3 such that the rotation of the knob 53 displaces the knob 53 axially with respect to the seat body 3. Preferably, the rib 32 of the seat body 3 is semi-cylindrical in cross section; and the knob 53 defines at its inner side a recess 532 configured in size and shape to accommodate the rib 53 of the seat body 3. As such, when the positioning pin 51 is located in the locking position (FIG. 5), the rib 32 of the seat body 3 is fitted in the recess 532 of the knob 53.

Figure 6:
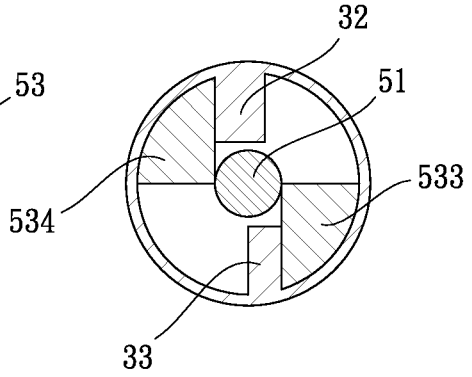
FIG. 6 is a section on line VI-VI in FIG. 5 to an even larger scale.
Figure 7:
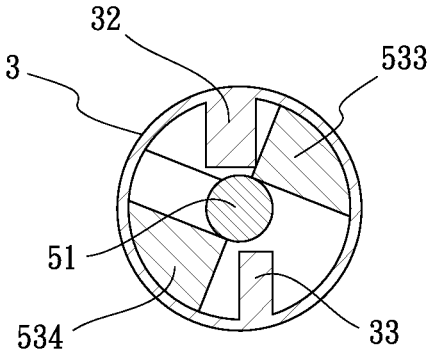
FIG. 7 is a view similar to FIG. 6, showing rotation of the knob (53)
Figure 9:
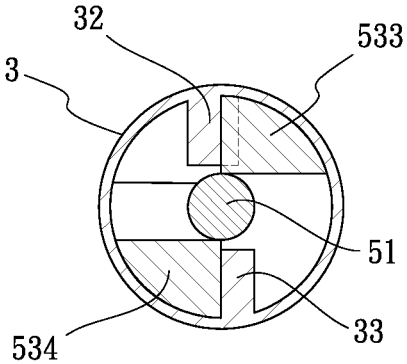
FIG. 9 is a section on line IX-IX in FIG. 8 to an even larger scale.

Referring to FIGS. 3 and 6, the confining block 33 of the seat body 3 is provided to limit the amount of rotation of the knob 53 in 90 degrees to lock or release the working jaw 4 on or from the seat body 3. On the other hand, the knob 53 is formed at its inner side with a first sectorial block 533 and a second sectorial block 534 opposite to each other. As such, when the positioning pin 51 is located in the locking position, as shown in FIG. 5, the first sectorial block 533 of the knob 53 abuts against one side of the confining block 33 of the seat body 3 while the second sectorial block 534 abuts against the rib 32 of the seat body 3. And, when the knob 53 is rotated in order to have the positioning pin 51 move from the locking position (FIG. 5) to the releasing position (FIG. 8), the rib 32 of the seat body 3 moves along the guiding slope 531 of the knob 53, as shown in FIG. 7, to lift up the first sectorial block 533 over against the rib 32 of the seat body 3, as shown in FIG. 9, and at the same time, the second sectorial block 534 abut against an opposite side of the confining block 33 of the seat body 3, which limiting further rotation of the knob 53.

As described above, the working jaws 4 with the press dies 41 and the female molds 42 may be very quickly and simply applied to the arm members 2 and the seat bodies 3, and removed therefrom by the rotation of the knob 53 when it is desired to substitute or to replace dies for any reason.

It is to be understood that the disclosed embodiments are illustrative in nature and the invention is not to be limited to any one or more embodiments except as set forth in the following claims.

What is claimed is:

1. Pliers comprising:

a pair of arm members;

a pair of handles connected to each other for movement of the arm members towards and away from each other;

at least one seat body secured in a receiving room of one of the arm members and defining a through hole in a direction substantially vertical to the arm member;

at least one working jaw detachably engaged with the seat body to be supported in the receiving room of the arm member, and defining in a side thereof an indentation to be communicated with the through hole of the seat body; and at least one control assembly including a knob disposed in an opening of the through hole of the seat body, and a positioning pin having a free end passing through the through hole of the seat body and an opposite end secured to an inner side of the knob; wherein the knob and the seat body are arranged in a manner that rotation of the knob displaces the knob axially with respect to the seat body, causing the positioning pin to move between a locking position where the free end of the positioning pin is engaged in the indentation of the working jaw to stop the working jaw from departing from the seat body, and a releasing position where the free end of the positioning pin is removed from the indentation of the working jaw to allow detachment of the working jaw from the seat body.

2. The pliers of claim 1, wherein the positioning pin is formed at the free end with an outer flange and at the opposite end with a threaded portion screwed in a screw hole of the knob; the seat body is formed an inner flange in the through hole thereof; and the control assembly further includes a spring disposed around the positioning pin and interposed between the outer flange of the positioning pin and the inner flange of the seat body.

3. The pliers of claim 2, wherein the opening of the through hole of the seat body is enlarged to form an annular bottom onto which a rib of the seat body is formed; and the knob is formed at the inner side thereof with a guiding slope in an arc corresponding to the rib of the seat body such that the rotation of the knob displaces the knob axially with respect to the seat body.

4. The pliers of claim 3, wherein the rib of the seat body is semi-cylindrical in cross section; the knob defines at its the inner side a recess configured in size and shape to accommodate the rib of the seat body; and when the positioning pin is located in the locking position, the rib of the seat body is fitted in the recess of the knob.

5. The pliers of claim 3, wherein the seat body is formed with a confining block substantially opposite to the rib on the annular bottom of the opening thereof; the knob is formed at its inner side with a first sectorial block and a second sectorial block opposite to each other; and when the positioning pin is located in the locking position, the first sectorial block abuts against one side of the confining block and the second sectorial block abuts against the rib of the seat body; and when the knob is rotated in order to have the positioning pin move from the locking position to the releasing position, the rib of the seat body moves along the guiding slope of the knob to lift up the first sectorial block over against the rib of the seat body and have the second sectorial block abut against an opposite side of the confining block.

6. The pliers of claim 1, further comprising another working jaw supported by the other arm member, wherein the working jaws are provided with press dies arranged side by side and female molds opposite to the press dies.

7. The pliers of claim 1, wherein the arm member is formed by two spaced apart, parallel metal sheets and the receiving room is defined in between the two metal sheets.

8. The pliers of claim 1, wherein the seat body is configured substantially L-shaped, and the working jaw defines a substantially L-shaped notch to accommodate the seat body so as to limit lateral movement of the working jaw.

* * * * *